United States Patent [19]

Flanagan

[11] 4,269,637

[45] May 26, 1981

[54] HIGH-PERFORMANCE MHD SOLID GAS GENERATOR

[75] Inventor: Joseph E. Flanagan, Woodland Hills, Calif.

[73] Assignee: Rockwell International Corporation, El Segundo, Calif.

[21] Appl. No.: 58,643

[22] Filed: Jul. 19, 1979

[51] Int. Cl.[3] ..... C06B 45/10

[52] U.S. Cl. ..... 149/19.1; 149/19.4; 149/19.6; 149/19.8; 149/19.91; 149/62; 149/88; 310/11

[58] Field of Search ..... 149/19.1, 19.3, 19.4, 149/19.6, 19.8, 19.91, 62, 88, 61; 310/11

[56] References Cited

U.S. PATENT DOCUMENTS

| | | | |
|---|---|---|---|
| 3,222,233 | 12/1965 | Matuszko et al. | 149/88 |
| 3,257,470 | 6/1966 | Gilliland | 149/88 |
| 3,562,309 | 2/1971 | Lovett | 149/88 |
| 3,733,223 | 5/1973 | Lohkamp | 149/61 |
| 3,779,008 | 12/1973 | Henderson et al. | 149/19.1 |
| 3,853,646 | 12/1974 | Frankel et al. | 149/88 |
| 3,873,860 | 3/1975 | Bergman et al. | 310/11 |
| 3,878,409 | 4/1975 | Gill et al. | 310/11 |
| 3,957,549 | 5/1976 | Baldwin | 149/19.91 |
| 4,092,190 | 5/1978 | Flanagan | 149/61 |
| 4,134,034 | 1/1979 | Dardai | 310/11 |

OTHER PUBLICATIONS

Borgardt et al., *J. Org. Chem.,* 31 (#9), 2806 (966).
Borgardt et al., *J. Org. Chem.,* 35 (#12), 4236 (1970).

*Primary Examiner*—Edward A. Miller
*Attorney, Agent, or Firm*—H. F. Hamann; Harry B. Field

[57] ABSTRACT

A solid propellant gas generator based upon dialkali tetranitroethane salts which produces high electron densities for magnetohydrodynamic (MHD) applications.

6 Claims, No Drawings

HIGH-PERFORMANCE MHD SOLID GAS GENERATOR

BACKGROUND OF THE INVENTION

1. Field of the Invention

This invention relates to gas generators and is particularly directed to solid propellant gas generators for producing high electron density gases for utilization in magnetohydrodynamic (MHD) systems.

2. Description of the Prior Art

Gas generators for the production of high electron density gases for utilization in MHD systems are based upon: (1) liquid propellant systems seeded with aqueous solutions of potassium or cesium salts (e.g. $KNO_3$, $CsNO_3$, $Cs_2CO_3$), or (2) solid propellant gas generators which have the potassium or cesium salts directly incorporated into the propellant matrix.

The liquid propellant systems are limited in the magnitude of electrons produced by two factors. First, the flame temperatures are limited to approximately 3300° K. since metallic fuels are not present. The generation of electrons from the ionization of the alkali molecules present ($M \rightarrow M^+ + e^-$) where M=K or Cs, is very exponentially temperature dependent. Second, the ratio of hydrogen to carbon present in the liquid fuel ranges from 1 to 2 depending upon the fuel's character (aromatic versus aliphatic). The water produced during combustion dissociates at high temperatures ($H_2O \rightarrow OH + H$), followed by the secondary reaction in which electrons are attached ($OH + e^{31} \rightarrow OH^-$), thereby reducing the effective free electron concentration.

Solid propellant electron gas generators based upon double-base binders highly loaded with oxidizers such as HMX which contain alkali salts such as $KNO_3$ and/or $CsNO_3$ and a metallic fuel have been developed. However, the hydrogen content of these solid propellants is still high due to the intrinsically high hydrogen content of the binder and especially the HMX, but flame temperatures are attained which exceed those of the liquid propellant systems by hundreds of degrees since a metallic fuel is present.

SUMMARY OF THE INVENTION

Accordingly, there is provided by the subject invention a solid propellant gas generator which comprises a dialkali tetranitroethane salts and mixtures thereof, an energetic binder system, metallic fuel, and an alkali salt or mixtures of alkali salts. Combustion products of the subject propellant contain high electron densities for magnetohydrodynamic applications.

OBJECTS OF THE INVENTION

Therefore, it is an object of the present invention to provide electrons from a solid propellant gas generator.

Another object of the present invention is to provide a solid propellant gas generator producing electrons wherein said solid propellant comprises a mixture of dialkali tetranitroethane salts, an energetic binder, a metallic fuel, and alkali salts.

Still another object of the present invention is to provide a solid propellant gas generator which has a controlable flame temperature.

Other objects, advantages, and novel features of the present invention will become apparent from the following detailed description of the invention.

DESCRIPTION OF THE PREFERRED EMBODIMENTS

In accordance with the present invention, there is provided a solid propellant gas generator having the capability to produce high electron density combustion products for magnetohydrodynamic applications. Basically, the subject solid propellant comprises a dialkali tetranitroethane salt or mixtures of salts, an energetic binder, a metallic fuel, and optional alkali salts or mixtures of alkali salts.

Dialkali tetranitroethane salts, of the general formula $[MC(NO_2)_2]_2$, where M=K or Cs, are synthesized by any conventional method. One such method is described by Borgardt in the Journal of Organic Chemistry, Vol. 31, page 2806, 1966. These salts are high density (>2.5 gm/cc), thermal stable, crystalline materials which are readily incorporated into solid propellants. The advantages of using these salts stem from their high oxidation index (O/C=4) while possessing no hydrogen and containing virtually all of the requisite alkali molecules for the ionization reaction.

State-of-the-art energetic binder systems comprise a polymer, a plasticizer, and a curing agent. Basically, any halogen-free, state-of-the-art energetic binder system can provide the desired physical, chemical, and ballistic properties; however, the following three systems are preferred: nitrocellulose, an isocyannate, a polyester, and a nitroplasticizer; ethyl acrylate-acrylic acid, an epoxide curing agent such as Union Carbide's Unox 221, and a nitroplasticizer; and glycidyl azide polymer (GAP), an isocyannate, and a nitroplasticizer. The nitroplasticizers are any conventional nitroplasticizers such as nitroglycerin (NG), triethyleneglycoldinitrate (TEGON), and trimethylolethanetrinitrate (TMETN). The most preferred state-of-the-art energetic binder system comprises GAP, an isocyannate and a nitroplasticizer.

In accordance with the present invention the metallic fuels of aluminum, zirconium, and boron are preferred, and aluminum is the most preferred.

Optional alkali salts operate as a secondary source of electrons. These salts can be nitrates of the general formula $MNO_3$, carbonates of the general formula $M_2CO_3$ and sulfates of the general formula $M_2SO_4$; wherein M can be potassium or cesium. The preferred alkali salts are $KNO_3$ and $CsNO_3$.

Although any combustible combination of the above ingredients will work to a greater or lesser degree, the preferred weight percentage of ingredients is from 50 to about 85 weight percent dialkali tetranitroethane, from about 10 to about 35 weight percent of an energetic binder system, and about 5 to about 30 weight percent of a metallic fuel. The most preferred weight percentage range is from about 65 to about 75 weight percent of the dialkali tetranitroethane, from about 15 to about 20 weight percent of an energetic binder system, from about 15 to about 20 weight percent of a metallic fuel and up to about 5 weight percent of an alkali salt. The performance of a typical solid propellant gas generator based upon the dialkali tetranitroethane salts is given in Table 1.

TABLE 1

| System | Electron Density ($e^-/cm^3$) |
|---|---|
| Liquid Oxygen/Kerosene/$Cs_2CO_3$ | $5.5 \times 10^{14}$ |

TABLE 1-continued

| System | Electron Density ($e^-/cm^3$) |
|---|---|
| Liquid Oxygen/Toluene/$Cs_2CO_3$ | $3.15 \times 10^{15}$ |
| Double-Base Binder/HMX/$KNO_3$/$CsNO_3$/Al | $6.11 \times 10^{15}$ |
| Dialkali tetranitroethane/ Energetic Binder/Al | $2.25 \times 10^{16}$ |

Thus, it can be seen that improvement of greater than threefold is obtained with the present invention over existing solid propellants and almost an order of magnitude improvement is obtained over the liquid propellant systems.

Care must be taken in the preparation of the above solid propellant gas generators not to introduce a halogen or ammonium nitrate. The introduction of these materials would effectively inhibit the critical ionization of the potassium and cesium.

Obviously, many modifications and variations of the present invention are possible in light of the above teachings. It is therefore to be understood that, within the scope of the appended claims, the invention may be practiced otherwise than as specifically described.

I claim:

1. A solid propellant electron-producing gas generator, which comprises:

a dialkali tetranitroethane salt selected from the group consisting of potassium tetranitroethane, cesium tetranitroethane, and mixtures thereof;

a halogen free energetic binder system; and a metallic fuel selected from the group consisting of aluminum, zirconium, boron, and mixtures thereof.

2. The solid propellant electron-producing gas generator of claim 1, which comprises:

from about 50 to about 85 weight percent of said dialkali tetranitroethane salts;

from about 10 to about 35 weight percent of said energetic binder system; and from about 5 to about 30 weight percent of said metallic fuels.

3. The solid propellant electron-producing gas generator of claim 1 wherein said metallic fuel is aluminum.

4. The solid propellant electron-producing gas generator of claim 1 which further comprises an alkali salt selected from the group consisting of $KNO_3$, $CsNO_3$, $K_2CO_3$, $Cs_2CO_3$, $K_2SO_4$, $Cs_2SO_4$, and mixtures thereof.

5. The solid propellant electron-producing gas generator of claim 4 wherein said alkali salts are selected from $KNO_3$ and $CsNO_3$.

6. The solid propellant electron-producing gas generator of claim 4 which comprises:

from about 65 to about 75 weight percent of said dialkali tetranitroethane;

from about 15 to about 20 weight percent of said energetic binder system;

from about 15 to about 20 weight percent of said metallic fuel; and up to about 5 weight percent of said alkali salts.

* * * * *

UNITED STATES PATENT AND TRADEMARK OFFICE

CERTIFICATE OF CORRECTION

PATENT NO. : 4,269,637

DATED : May 26, 1981

INVENTOR(S) : Joseph E. Flanagan

It is certified that error appears in the above-identified patent and that said Letters Patent are hereby corrected as shown below:

Title Page, Other Publications, line 1, delete "(966)" and insert --(1966)--.

Column 1, line 32, delete "$(OH + e^{31} \rightarrow OH^-)$" and insert --$(OH+e^- \rightarrow OH^-)$--;
line 48, delete "a" second occurrence.

Column 2, line 35, delete "(TEGON)" and insert --(TEGDN)--.

Signed and Sealed this

Nineteenth Day of January 1982

[SEAL]

Attest:

GERALD J. MOSSINGHOFF

Attesting Officer

Commissioner of Patents and Trademarks